United States Patent [19]

Zitz et al.

[11] Patent Number: 4,776,445

[45] Date of Patent: Oct. 11, 1988

[54] DEVICE FOR TRANSFERRING THE CUP HEAP OF DEBRIS ONTO A DRIFT CONVEYING MEANS

[75] Inventors: Alfred Zitz; Heinrich Süssenbeck, both of Zeltweg; Siegfried Sigott, Ferlach, all of Austria

[73] Assignee: Voest-Alpine Aktiengesselschaft, Vienna, Austria

[21] Appl. No.: 910,867

[22] Filed: Sep. 24, 1986

Related U.S. Application Data

[63] Continuation of Ser. No. 798,367, Nov. 18, 1985, abandoned, which is a continuation of Ser. No. 505,823, Jun. 20, 1983, abandoned.

[30] Foreign Application Priority Data

Jul. 5, 1982 [AT] Austria ..... A2593/82

[51] Int. Cl.[4] ..... B65G 41/00

[52] U.S. Cl. ..... 198/303; 198/586; 198/587; 198/589

[58] Field of Search ..... 198/303, 304, 587, 589, 198/594, 315, 314, 316.1, 317, 586, 592; 299/18, 43–45, 64–67

[56] References Cited

U.S. PATENT DOCUMENTS

| | | | |
|---|---|---|---|
| 2,428,513 | 10/1947 | Cooley | 198/304 |
| 3,231,064 | 1/1966 | Towles | 198/303 X |
| 3,279,584 | 10/1966 | Towles | 198/303 |
| 3,361,248 | 1/1968 | Daymon | 198/303 |
| 3,563,364 | 2/1971 | Arndt | 198/304 X |
| 3,782,536 | 1/1974 | Toney | 198/316 |
| 4,361,219 | 11/1982 | Aldridge et al. | 198/315 |

*Primary Examiner*—Robert J. Spar
*Assistant Examiner*—Lyle Kimms
*Attorney, Agent, or Firm*—Cushman, Darby & Cushman

[57] ABSTRACT

A device for transferring the debris cut by a cutting machine during mining operations onto a drift conveyer comprises a pair of bridge conveyers connected to each other. The first bridge conveyer has its receiving end pivotally connected to the cutting machine with its discharge end being supported by a dirigible chassis. The second bridge conveyer is supported on the chassis of the first conveyer and pivotable about its horizontal and vertical axis. The support chassis is capable of being swivelled around a vertical axis relative to the first bridge conveyer.

7 Claims, 2 Drawing Sheets

DEVICE FOR TRANSFERRING THE CUP HEAP OF DEBRIS ONTO A DRIFT CONVEYING MEANS

This is a continuation of application Ser. No. 798,367 filed Nov. 18, 1985 now abandoned, which is a continuation of application Ser. No. 505,823 filed June 20, 1983 now abandoned.

The invention refers to a device for transferring the heap of debris cut by a cutting machine onto a drift convey means placed on the floor. From the U.S. Pat. No. 2,322,481 it is known to link for this purpose to the conveying means of the cutting machine a length-adjustable bridge conveyer. Such a length-adjustable bridge conveyer requires, however, expensive construction and above all the possibilities are strongly reduced to transfer the heap of debris onto the drift conveying means in the various positions of the cutting machine. From the DE-OS No. 2 202 459 it is further known to annex to the cutting machine a flexible conveyer belt. Such an embodiment is, however, of extremely expensive construction and subject to operational troubles and placing of such a flexible conveyer belt on the floor requires a relatively great expenditure of work. In particular, the invention refers to such a device in which bridge conveyers are linked one to the other for pivotal movement around a vertical axis and in which the receiving end of the first bridge conveyer, as seen in transport direction, can pivotally be linked to the cutting machine and the discharge end of a subsequent bridge conveyer can be linked to a drift conveying means adapted to be placed on the floor. Such an embodiment has become known from U.S. Pat. No. 3,782 536. In this case, several bridge conveyers are pivotally connected one with the other, one of the bridge conveyers having in its middle portion an undercarriage. Such an embodiment can be maneuvered only with difficulties.

It is an object of the invention to provide a device which allows removal of the cut heap of debris without or with an only unimportant operational standstill of the cutting work and which can easily be maneuvered. The invention essentially consists in that the discharge end of the preceding bridge conveyer linkable to the cutting machine is supported by means of a dirigible chassis and in that the subsequent bridge conveyer is supported for being swivelled around a vertical axis and around a horizontal axis on the chassis or discharge end, respectively, of the preceding bridge conveyer in a cantilevering manner. By supporting the discharge end of the preceding bridge conveyer linkable to the cutting machine on a dirigible chassis one can select the position where this discharge end is positioned and by such support a momentary fixed point is provided from where the subsequent bridge conveyer can be brought in its position for transferring the material to be transported onto the drift conveying means. By this type of support it is made possible to horizontally or vertically swivel the subsequent bridge conveyer starting from the momentary fixed point. In this case, the preceding bridge conveyer is not only linked to the cutting machine for pivotal movement around a vertical axis but conveniently also for pivotal movement around a horizontal axis so that any uneveness of the floor can be taken in consideration. According to the invention there is preferably provided a drive means, for example a hydraulic cylinder-piston-aggregate, for upwardly swivelling the subsequent bridge conveyer and conveniently there is also provided a drive means for horizontally swivelling the subsequent bridge conveyer. This provides for the chassis arranged on the discharge end of the preceding bridge conveyer and for the pivotal connection of this preceding bridge conveyer to the cutting machine the possibility to form for the pivotal drive means a thrust support capable of receiving high forces. According to the invention, the subsequent bridge conveyer is conveniently of shorter length than the preceding bridge conveyer and thus easily maneuverable.

According to the invention, the chassis can be swivelable around a vertical axis relative to the preceding bridge conveyer.

According to a preferred embodiment of the invention, the chassis comprises a drive means so that even heavy bridge conveyers can be maneuvered.

The discharge end of the subsequent bridge conveyer, which discharge end conveniently has a discharge hopper, can be brought in a freely cantilevering fashion above the drift conveying means so that the heap of debris is thrown onto the drift conveying means. According to the invention, the discharge end of the subsequent bridge conveyer is, however, conveniently adapted to be supported on the drift conveyer means and to be shifted in longitudinal direction thereof and can be guided for being swivelled around an approximately vertical axis. In this manner, the discharge end of the subsequent bridge conveyer part is automatically maintained in its position above the drift conveying means, noting that the discharge end can transport the material, for example, into a discharge hopper arranged for shifting movement on the drift conveying means. During operation, the drift conveying means can be elongated, as seen in transport direction, in front of that place where the subsequent bridge conveyer throws the heap of debris onto the drift conveying means so that one can work without any interruption of operation. If the drift advancing path of the cutting machine is kinked, a drift conveying means extending in direction of the cutting path must be newly erected. In this case it is essential that the discharge end of the subsequent bridge conveyer part can again be put on top of the newly erected drift conveying means. In view of the subsequent bridge conveyer being supported on the discharge end of the preceding bridge conveyer and being swivelable from this preceding bridge conveyer in height direction and in lateral direction, there are no difficulties to bring the discharge end of the subsequent bridge conveyer above this newly erected drift conveying means.

According to an advantageous embodiment of the invention, an operator cabin can be arranged at the area of tne pivotal link of the subsequent bridge conveyer to the preceding bridge conveyer and is preferably arranged on the preceding bridge conveyer. From this operator cabin, an operator can most easily control the relative position of both bridge conveyer parts by means of both the drive means for as well as the steering means of the chassis and the swivelling movements of the subsequent bridge conveyer, and this operator can also supervise the transfer of the heap of debris.

The invention thus provides the possibility to cut kinked galleries or galleries laterally branching off the main gallery, and above all it becomes also possible to move, when working with recovery of pillars, the cutting machine greatly independent from the drift conveying means. Conveniently, according to the invention, the subsequent bridge conveyer is linked to the preceding bridge conveyer for being swivelled for an angle of approximately 270° .

In the drawing, the invention is schematically illustrated by embodiments.

In the drawing

Figure 1:
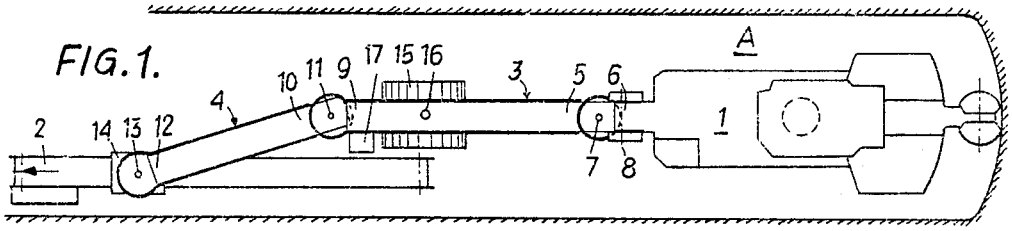
FIGS. 1 to 3 show devices in various operating positions in a top plan view.
Figure 2:
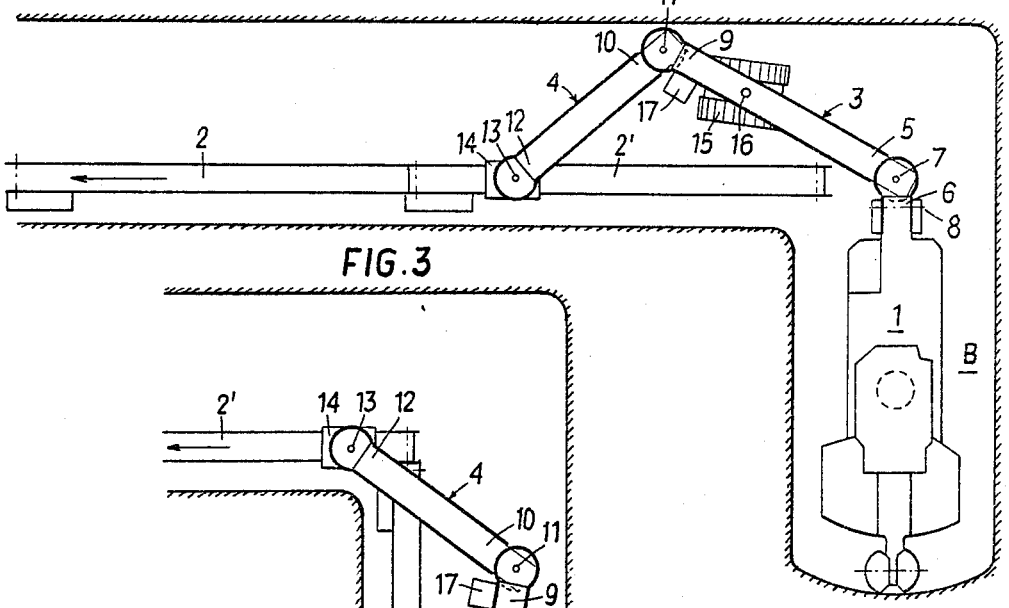
Figure 3:
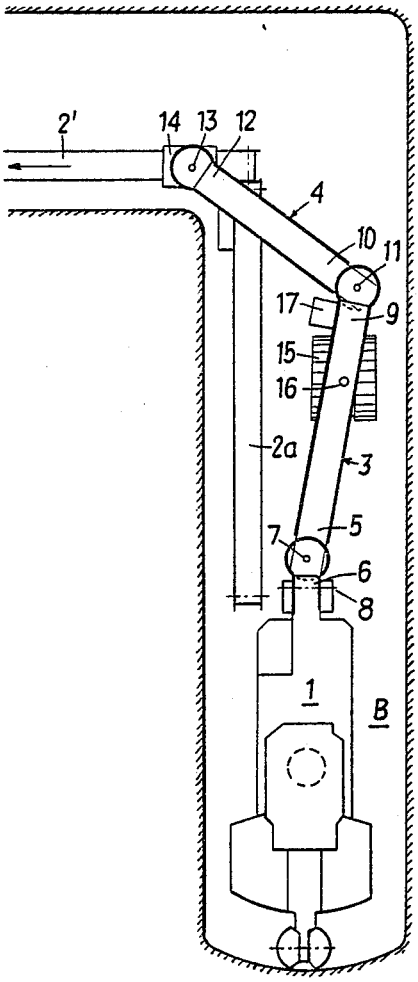
Figure 6:
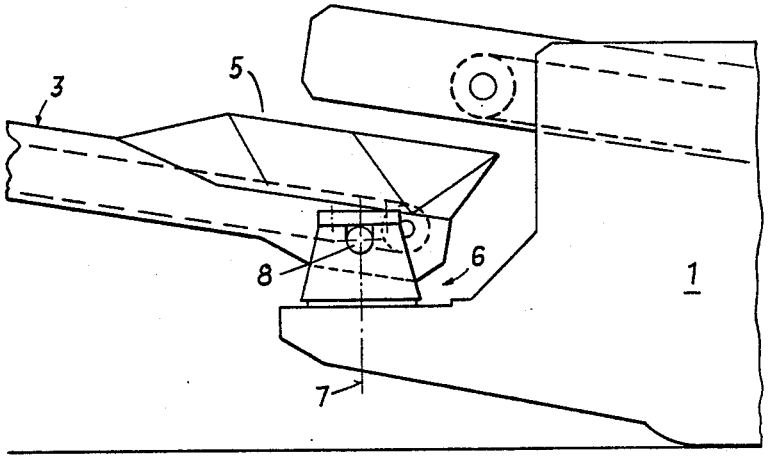
FIG. 6 shows the type of pivotal link of the preceding bridge conveyer to a cutting machine.

In the FIGS. 1 to 3, 1 is the cutting machine, 2 is the drift conveying means, 3 is the preceding bridge conveyer and 4 is the subsequent bridge conveyer. These bridge conveyers 3 and 4 can, for example, be chain conveyers. The receiving end 5 of the preceding bridge conveyer 3 is pivotally linked to the cutting machine at 6. As is shown in FIG. 6, the receiving end 5 is pivotally linked for being swivelled around a vertical axis 7 and around a horizontal axis 8.

The receiving end 10 of the subsequent bridge conveyer is pivotally linked at 11 to the discharge end 9 of the preceding bridge conveyer 3. The discharge end 12 of the subsequent bridge conveyer 4 is linked at 13 to a sliding carriage 14 which is slidably guided on the stationarily placed drift conveying means 2 in longitudinal direction thereof. A discharge hopper, not shown, can be provided at the area 13 of the pivotal link. In proximity of the area 11 of pivotal link, the preceding bridge conveyer 3 is supported by means of a caterpillar-type chassis 15. This caterpillar-type chassis can be swivelled around a vertical axis 16 relative to the preceding bridge conveyer 3 and has a drive means, not shown, so that the area 11 of pivotal link can arbitrarily be moved. 17 is an operator's cabin from where the chassis 15 can be controlled.

In the representation of FIG. 1 a straight gallery A is being cut. The drift conveying means 2 is erected laterally within the gallery and can thus be elongated without being hindered by the cutting machine and by the bridge conveyers 3, 4. The elongated portion is designated 2' in FIG. 2.

In FIG. 2 cutting of a gallery B is shown which is branched off the gallery A at a right angle. In view of both bridge conveyers 3 and 4 being pivotably arranged, the heap of debris can without difficulties be transferred onto the drift conveying means 2 by means of the bridge conveyers 3, 4.

If according to FIG. 3 the gallery B is further advanced, a drift conveying means 2*a* is placed within the gallery B and the heap of debris is then transferred from the drift conveying means 2*a* on the drift conveying means 2. With still further progressing drift advance within the gallery B, the sliding carriage 14 is then placed onto the drift conveying means 2*a* and transport of the material is continued in the manner previously described.

Figure 4:
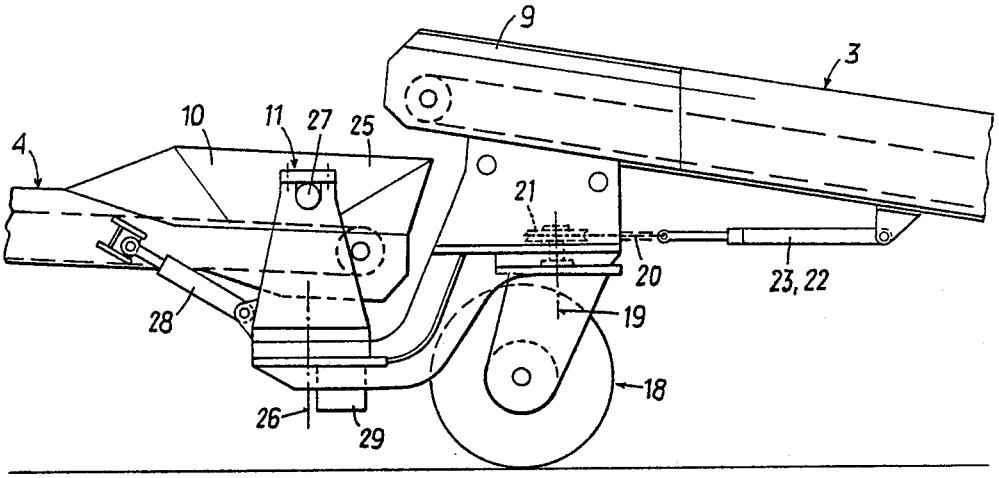
FIGS. 4 and 5 show in an elevation and in a top plan view, respectively, the area of pivotal link of the subsequent bridge conveyer to the preceding bridge conveyer
Figure 5:
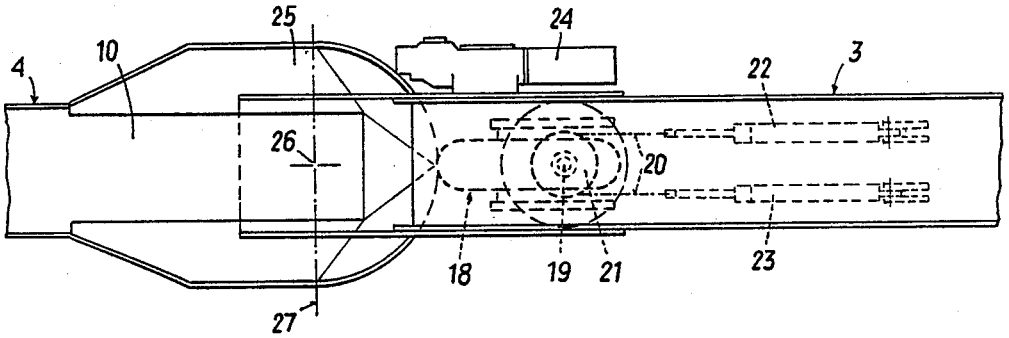

FIG. 4 shows an example in which the caterpillar-type chassis 15 is replaced by a wheel undercarriage. This wheel undercarriage 18 is arranged at the area of the discharge end 9 on the preceding bridge conveyer 3. The chassis 18 is supported on the preceding bridge conveyer 3 for being swivelled around a vertical axis 19. Steering is effected by means of a chain 20 which is placed around a chain wheel 21 connected with the chassis 18. Two cylinder-piston-aggregates 22 and 23 are acting on the ends of the chain and thus steer the wheel undercarriage 18. This wheel undercarriage is equipped with a drive means represented by the reference numeral 24.

The receiving end 10 of the subsequent bridge conveyer 4 is linked at 11 to the discharge end 9 of the preceding bridge conveyer 3. The discharge end 9 of the preceding bridge conveyer 3 supplies material into a discharge hopper 25 provided at the receiving end 10 of the subsequent bridge conveyer 4.

The subsequent bridge conveyer 4 is connected with the preceding bridge conveyer 3 for swivelling movement around a vertical axis 26 and around a horizontal axis 27. The preceding bridge conveyer 4 can be swivelled in upward direction and be lowered by means of a cylinder-piston-aggregate 28. A swivelling drive schematically shown at 29 is provided for the lateral swivelling movement.

Drive means for the conveyer chains of the preceding bridge conveyer 3 and of the subsequent bridge conveyer 4 is not shown.

What is claimed is:

1. Apparatus for receiving cut debris from a conveyor carried by a mining machine and for transferring the cut debris onto a drift conveyor which is mounted on a mine floor, said apparatus comprising a first conveyor having a discharge end and having a receiving end which receives debris from the conveyor carried by the mining machine and which is supported by the cutting machine and which is connected to the cutting machine for pivotal movement about a vertical axis and a horizontal axis; means for supporting the discharge end of said first conveyor and for rendering said first conveyor laterally maneuverable about said vertical axis at the receiving end of said first conveyor, said means including floor-engaging carriage means connected to said first conveyor intermediate its ends and supporting the discharge end of said first conveyor in a position above the mine floor and said means further including first drive means for moving said carriage means over the mine floor both in the direction of travel of the mining machine and in a direction lateral thereto; a second conveyor which is shorter than said first conveyor, said second conveyer having a discharge end for discharging debris on to a drift conveyor and a receiving end which receives debris from said first conveyor and which is supported by and pivotally connected to the discharge end of said first conveyor for pivoting movement about vertical and horizontal axes, the discharge end of the second conveyor being connected to and supported by the drift conveyor; and second drive means connected between said first and second conveyors for swivelling said second conveyor in horizontal and vertical directions with respect to said first conveyor.

2. Apparatus as in claim 1 wherein said carriage means includes an endless track unit.

3. Apparatus as in claim 1 wherein said carriage includes a wheel and means to steer said wheel relative to said first conveyer.

4. Apparatus as in claim 1 wherein the discharge end of said second conveyer includes a slide carriage supported on said drift conveyer for movement in the longitudinal direction of the drift conveyer, said second conveyer further being mounted for swivelling about a vertical axis on the slide carriage.

5. Apparatus as in claim 1 wherein said second conveyer can swing approximately 270° relative to said first conveyer, about the vertical axis at the receiving end of said second conveyer.

6. Apparatus as in claim 1 wherein said drive means connected between said first and second conveyers includes a hydraulic piston and cylinder unit.

7. Apparatus as in claim 2 wherein said first conveyer is mounted on said carriage for pivotal movement about a vertical axis.

* * * * *